US008025188B2

(12) United States Patent
White

(10) Patent No.: US 8,025,188 B2
(45) Date of Patent: Sep. 27, 2011

(54) POWDER FEED SYSTEM

(75) Inventor: Michael A. White, Brookfield, CT (US)

(73) Assignee: MannKind Corporation, Valencia, CA (US)

( * ) Notice: Subject to any disclaimer, the term of this patent is extended or adjusted under 35 U.S.C. 154(b) by 836 days.

(21) Appl. No.: 12/005,914

(22) Filed: Dec. 28, 2007

(65) Prior Publication Data

US 2008/0210705 A1 Sep. 4, 2008

Related U.S. Application Data

(60) Provisional application No. 60/877,683, filed on Dec. 28, 2006.

(51) Int. Cl.
*G01F 13/00* (2006.01)

(52) U.S. Cl. ..... 222/227; 222/238

(58) Field of Classification Search ..... 222/1, 142, 222/216–248, 31

See application file for complete search history.

(56) References Cited

U.S. PATENT DOCUMENTS

| | | | | | |
|---|---|---|---|---|---|
| 847,901 | A | * | 3/1907 | Caldwell | 222/218 |
| 1,033,907 | A | * | 7/1912 | Kinney | 241/87.1 |
| 1,724,805 | A | * | 8/1929 | Root | 222/180 |
| 2,700,855 | A | | 2/1955 | Ketchpel | |
| 3,353,722 | A | * | 11/1967 | Mehta | 222/218 |
| 3,656,518 | A | * | 4/1972 | Aronson | 141/1 |
| 5,564,329 | A | * | 10/1996 | Tomimatsu | 99/334 |
| 6,109,488 | A | * | 8/2000 | Horton | 222/636 |
| 6,283,176 | B1 | * | 9/2001 | Wurst et al. | 141/144 |
| 6,347,648 | B1 | * | 2/2002 | Wegman et al. | 141/1 |
| 2008/0202630 | A1 | | 8/2008 | Kax et al. | |

FOREIGN PATENT DOCUMENTS

DE 32 10 787 A1 10/1983

OTHER PUBLICATIONS

Bosch Verpackungstechnik, Operating Instructions, 14 pages, 2001 or earlier.

Search Report and Written Opinion mailed May 19, 2008 for International Application No. PCT/US2007/026465.

* cited by examiner

*Primary Examiner* — Kevin P Shaver
*Assistant Examiner* — Andrew Bainbridge
(74) *Attorney, Agent, or Firm* — Wolf, Greenfield & Sacks, P.C.

(57) ABSTRACT

A fine powder is reliably dispensed from a hopper into containers on a moving conveyor belt with the assistance of a powder feed system. The hopper serves as a powder inlet that dispenses by gravity into a feed chamber that is form fitted to the sweep of a relatively slow rotating feed wheel with two spaced sets of pins. A relatively fast rotating agitator is located below the feed wheel which has a series of agitating blades that rotate between the span of the feed wheel pins, the blades in at least one embodiment resemble a J-shape. The agitator is located directly above a rotary trap chamber wheel, which has recesses that take doses of powder and dispense them into awaiting containers moving on a conveyor belt below.

18 Claims, 7 Drawing Sheets

POWDER FEED SYSTEM

CROSS-REFERENCE TO RELATED APPLICATION

This application claims priority based on Provisional Application Ser. No. 60/877,683, filed Dec. 28, 2006, which is hereby incorporated by reference in its entirety.

FIELD OF THE INVENTION

This invention relates to methods and apparatus for feeding powder to a powder dispensing device. The powder dispensing device may dispense controlled quantities of powder into cartridges or other containers. The powder can contain a drug, but the invention is not limited in this respect.

BACKGROUND OF THE INVENTION

Powders are used in a variety of applications, including medical applications. In one example, it has been proposed to deliver certain types of drugs to patients by inhalation of a powder as a delivery mechanism. One particular example uses diketopiperazine microparticles known as TECHNOSPHERE® microparticles. The TECHNOSPHERE microparticles have a platelet surface structure and can be loaded with a drug. One use of these microparticles is the delivery of insulin by inhalation. An inhaler having a replaceable cartridge or capsule containing the drug powder is used for drug delivery.

In the commercialization of drug delivery by inhalation, large numbers of cartridges containing the drug must be produced in an efficient and economical manner. In particular, the cartridges must be filled with precisely controlled quantities of the powder. While TECHNOSPHERE microparticles are highly effective for drug delivery by inhalation, the platelet surface structure causes TECHNOSPHERE powders to be cohesive and somewhat difficult to handle.

One prior art cartridge filling system includes a feed chamber which delivers powder to a dosing wheel. The dosing wheel, in turn, dispenses controlled quantities of powder into cartridges. The prior art system utilizes vibration and a large paddle wheel to facilitate the flow of powder from a hopper through the feed chamber to the dosing wheel. While the prior art system is generally functional, the energy imparted to the Technosphere microparticles causes the powder to compress and performance to be highly variable. The performance of the prior art system depends, at least in part, on the cohesiveness of the powder being handled, which may range from highly cohesive to free flowing.

Accordingly, there is a need for improved powder feeding methods and apparatus.

SUMMARY OF THE INVENTION

According to a first aspect of the invention, a powder feed system comprises a housing that defines a feed chamber to hold powder, the feed chamber having a powder inlet and a powder outlet, at least one feed wheel in the feed chamber, the feed wheel rotating about a feed wheel axis, at least one agitator positioned in the feed chamber to move the powder from the feed wheel to the powder outlet of the feed chamber, the agitator rotating about an agitator axis, and a drive mechanism to rotate the feed wheel about the feed wheel axis and to rotate the agitator about the agitator axis.

The feed wheel can include a feed wheel hub and pins that extend radially from the feed wheel hub. The agitator can include an agitator hub and agitator elements, such as J-shaped pins, that extend from the agitator hub. The drive mechanism can include a feed wheel motor and an agitator motor. The feed chamber can be configured to limit dead space where powder can accumulate and become compacted.

According to a second aspect of the invention, a method for feeding powder comprises loading powder into a feed chamber having a powder outlet, rotating a feed wheel in the feed chamber, and rotating an agitator in the feed chamber, wherein the agitator is positioned to move powder from the feed wheel to the powder outlet.

According to a third aspect of the invention, a powder fill system comprises a powder feed system and a powder dispensing device. The powder feed system includes: a housing defining a feed chamber, a powder inlet and a powder outlet; a feed wheel and an agitator positioned in the feed chamber to move powder from the powder inlet to the powder outlet; and a drive mechanism to rotate the feed wheel and the agitator. The powder dispensing device is positioned below the powder outlet to dispense a controlled quantity of powder to a powder container.

BRIEF DESCRIPTION OF THE DRAWINGS

For a better understanding of the present invention, reference is made to the accompanying drawings, in which.

DETAILED DESCRIPTION

Figure 1A:
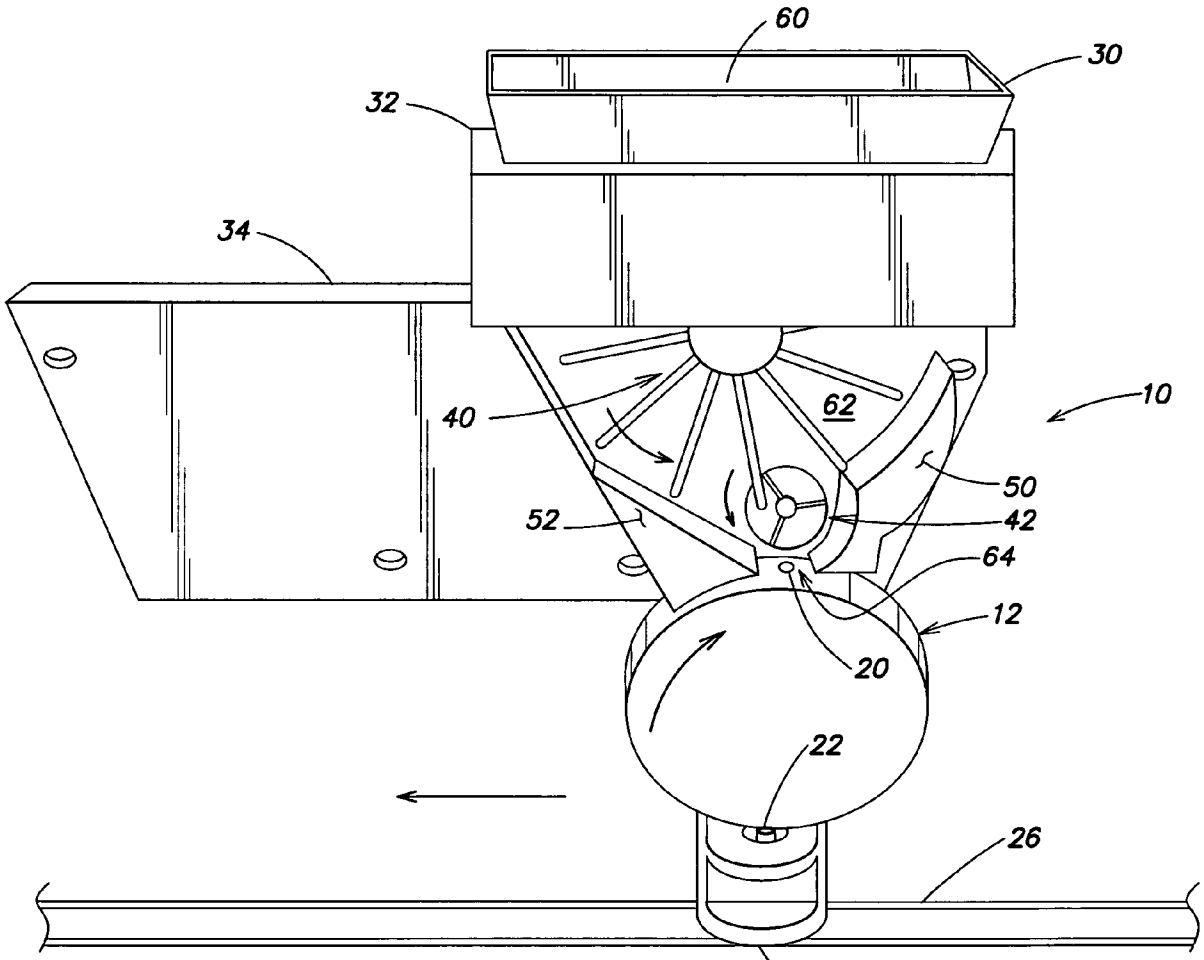
FIG. 1A is a perspective view of a powder fill system in accordance with the first embodiment of the invention.
Figure 1B:
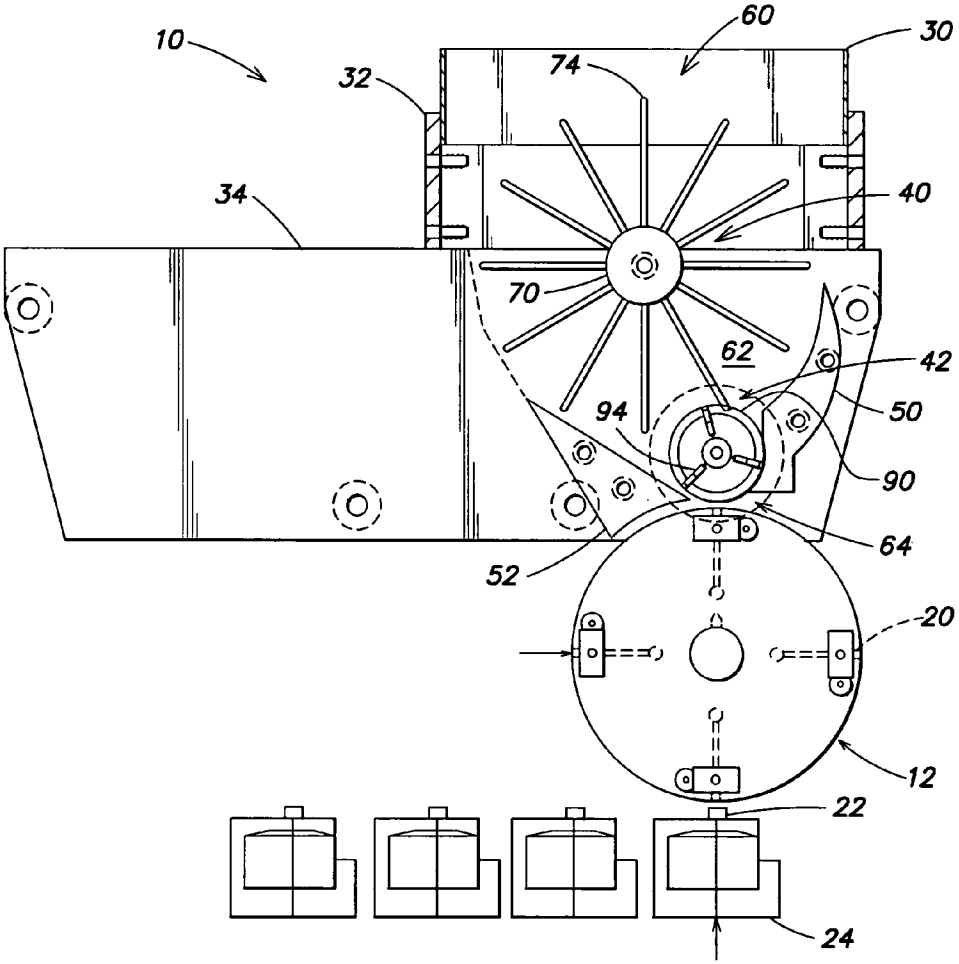
FIG. 1B is a cross-sectional front elevation view of the powder fill system of FIG. 1A.

A powder fill system in accordance with a first embodiment of the invention is shown in FIG. 1. The powder fill system includes a powder feed system 10, which supplies powder to a dispensing device, such as a dosing wheel 12. Dosing wheel 12, in turn, dispenses controlled quantities of powder to cartridges 22. The powder feed system is shown in greater detail in FIGS. 2-5.

The dosing wheel 12 includes a series of dosing holes 20, which can be spaced apart, for example, at 90° intervals and which retain powder by suction. As the dosing wheel 12 rotates, the powder is delivered to a cartridge 22 in a holder 24. The powder dose delivered to each cartridge 22 from dosing hole 20 is typically in a range of 1 to 100 milligrams, but need not be limited to this range. In a practical system, multiple cartridges 22 in holders 24 move along a conveyor 26 and are filled by dosing wheel 12. It will be understood that different powder dispensing devices can be used within the scope of the invention. In some embodiments, the powder dispensing device can comprise a dosing disk. Furthermore, retention of powder in the dosing hole by suction is not essential. In addition, the powder fill system can dispense powder to any type of powder container.

An embodiment of powder feed system 10 is described with reference to FIGS. 1-5, where like elements have the same reference numerals. The powder feed system of FIGS. 1-5 includes a hopper 30, a housing that defines a feed chamber 62, a feed wheel 40, and an agitator 42. Feed wheel 40 and agitator 42 are located in feed chamber 62. In the embodiment of FIGS. 1-5, housing components include a feed frame 32, a flange plate 34 and chamber inserts 50 and 52.

The hopper 30 provides a flared opening to feed frame 32 and permits powder to be easily loaded into the system. The feed chamber of the powder feeding system 10 is relatively narrow, and in the absence of hopper 30, it would be difficult to load powder into the system without spillage. Hopper 30 defines a powder inlet 60.

Feed chamber 62 extends from powder inlet 60 to a powder outlet 64. Powder is supplied through powder outlet 64 to dosing wheel 12 or another dispensing device. In the embodiment of FIGS. 1-5, feed chamber 62 is partially enclosed by one or more components of the fill system to which the feed system is mounted. Thus, feed chamber 62 is defined by housing components including feed frame 32, flange plate 34, a housing plate 66 (FIG. 5) and chamber inserts 50 and 52. Housing plate 66 is a component of the powder fill system in this embodiment. It will be understood that the housing which defines feed chamber 62 may have different configurations within the scope of the invention. In the embodiment of FIGS. 1-5, feed chamber 62 has an internal thickness of 0.75 inch. It will be understood that the feed chamber thickness can be varied based on the physical characteristics of the powder being handled and the components of the powder feed system.

In the embodiment of FIGS. 1-5, flange plate 34 serves as a frame for mounting of components of the powder feed system 10. Hopper 30, feed frame 32, feed wheel 40, agitator 42 and chamber inserts 50 and 52 are mounted to the front side, or inboard side, of flange plate 34. Drive motors for the feed wheel 40 and the agitator 42 can be mounted to the back side, or outside, of flange plate 34. The flange plate 34 also functions as an adaptor plate for mounting of the powder feed system 10 to an existing powder fill system. The configuration of the flange plate 34 can be changed within the scope of the invention for mounting to other powder fill systems. For example, flange plate 34 can be replaced with a housing which encloses feed chamber 62.

Feed wheel 40 includes a feed wheel hub 70 that rotates about a feed wheel axis 72. Feed wheel pins 74, or spokes, extend radially from feed wheel hub 70. In the embodiment of FIGS. 1-5, feed wheel 40 includes twelve pins 74 that are straight and that have lengths of 2.5 inches. In one example, feed wheel hub 70 is a stainless steel disk having a diameter of 1.25 inches and a thickness of 0.75 inch. The overall diameter of feed wheel 40 can extend from the top of feed frame 32 and 0.375 inch into the tip radius of agitator 42.

Figure 4:
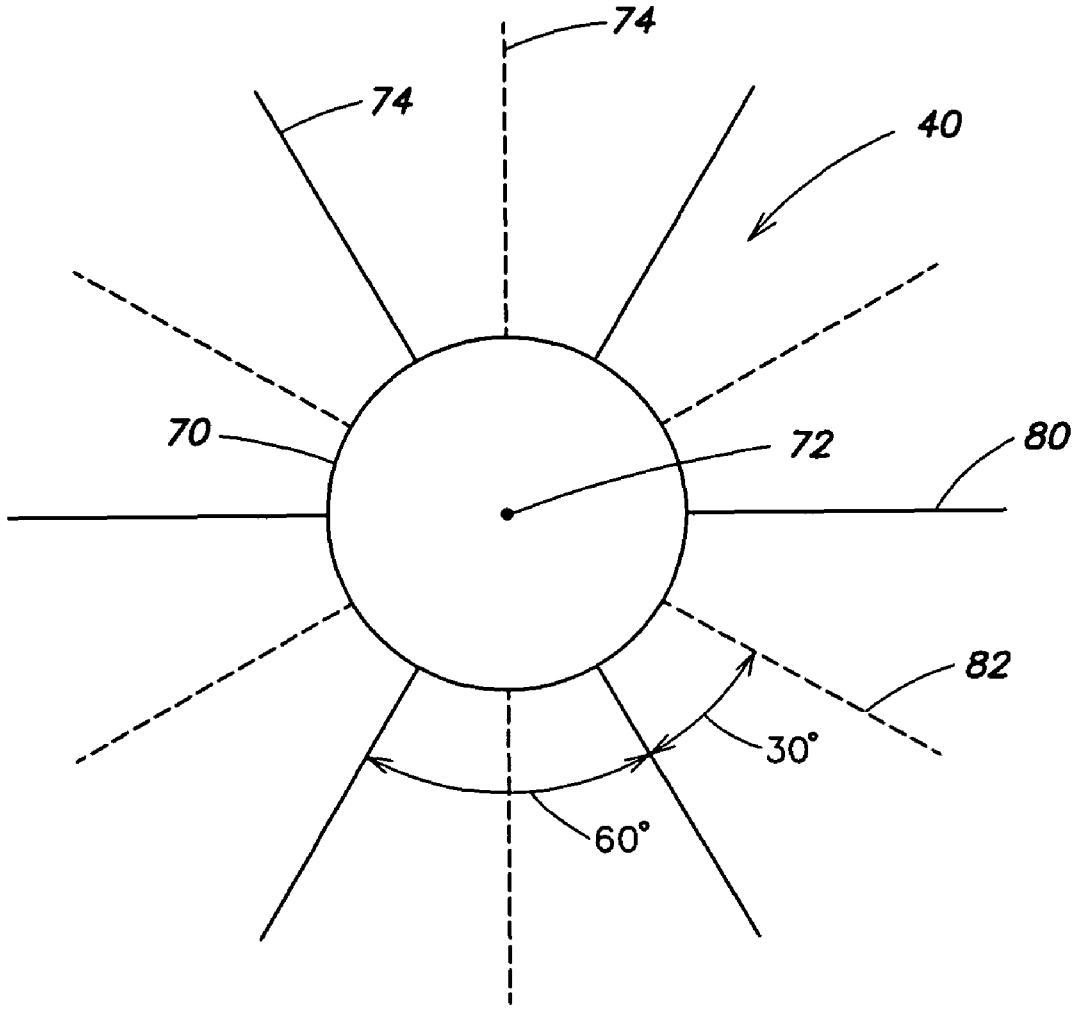
FIG. 4 is a schematic front elevation view of the feed wheel.
Figure 5:
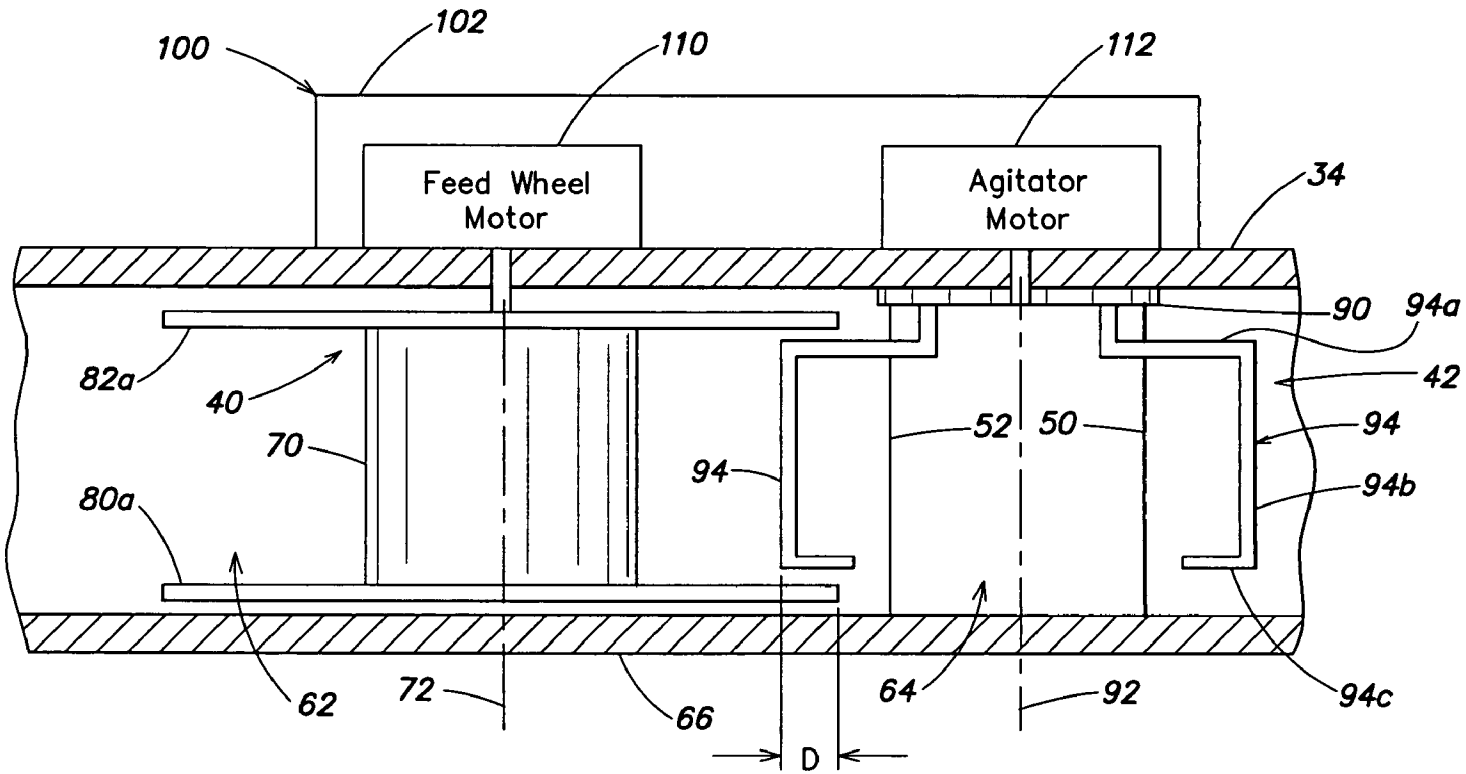
FIG. 5 is a schematic cross-sectional view of the powder feed system.

As shown in FIG. 4, the configuration of feed wheel pins 74 can include a first pin set 80 of six pins and a second pin set 82 of six pins. The pin sets 80 and 82 are axially spaced apart along feed wheel axis 72. The first pin set 80 can be positioned on one side of feed wheel hub 70, with the six pins spaced 60° apart. The second pin set 82 can be positioned on the other side of feed wheel hub 70, with the six pins spaced 60° apart. The pin sets 80 and 82 can be offset by 30° in a circumferential direction to provide an equal spacing of the twelve pins around feed wheel hub 70. Volumes 80*a* and 82*a* through which respective pin sets 80 and 82 travel are shown in FIG. 5.

The feed wheel 40 and the agitator 42 can rotate in the same direction so that powder is transferred from the feed wheel 40 to the agitator 42. The number, size, shape, location on the hub and diameter of the pins 74 can be varied to optimize the configuration for powders with different physical characteristics. The rotational speed of the feed wheel 40 can also be varied depending on the flow characteristics of the powder. The agitator 42 can interact with the feed wheel 40 so that powder is conveyed from one to the other. The feed wheel 40 provides a continuous supply of powder to the agitator 42, so that the agitator is not deprived of powder. The feed wheel prevents the creation of a void in the powder bed over the powder outlet 64. The feed wheel 40 removes the pressure that would otherwise be imparted to the powder near the agitator 42 by an uninterrupted, relatively high powder bed height.

Agitator 42 can include an agitator hub 90 that rotates about an agitator axis 92, and agitator elements 94 affixed to agitator hub 90. Agitator axis 92 can be parallel to feed wheel axis 72. In the embodiment of FIGS. 1-5, agitator 42 includes three agitator elements 94 equally spaced around agitator hub 90. Each of the agitator elements 94 can be a J-shaped pin, as best shown in FIG. 5. The J-shaped agitator elements 94 are positioned between first pin set 80 and second pin set 82 of feed wheel 40. This configuration permits the agitator 42 to capture powder and convey it to a position over powder outlet 64. The J-shape of the agitator elements allows a small amount of powder to be plowed into position above powder outlet 64.

In one embodiment, agitator 42 includes a stainless steel disk having a diameter of 1.25 inches and three J-shaped stainless steel agitator elements 94. In some embodiments, the J-shaped agitator elements 94 include intersecting straight sections 94*a*, 94*b* and 94*c*, as shown in FIG. 5. The J-shaped agitator elements can be dimensioned so that a straight section 94*b* at the base of the J-shaped agitator element pushes powder into powder outlet 64. The agitator elements are mounted 120° apart and move directly over the powder outlet 64 in a continuous motion, thereby filling the outlet with powder. The agitator hub 90 of agitator 42 fits into a hole in flange plate 34, and the hole can be sealed with a PTFE seal, for example.

The agitator 42 rotates in the opposite direction with respect to dosing wheel 12 in this embodiment. In other embodiments using different dispensing devices, the rotation can be reversed, if necessary. The number, size, shape, location on the hub and diameter of the agitator elements 94 can be varied to optimize the configuration for powders with different physical properties. The rotational speed of agitator 42 can also be varied depending on the flow characteristics of the powder and the dispensing device being utilized.

In some embodiments, the agitator 42 and the feed wheel 40 interact so that powder is conveyed from one to the other and over the powder outlet 64. In particular, the outer diameters of the feed wheel 40 and the agitator 42 can overlap, but the devices are configured to avoid physical contact. In the embodiment of FIG. 5, the agitator elements 94 can rotate between pin sets 80 and 82, thus overlapping the rotation of feed wheel 40 and agitator 42 while avoiding physical contact. In the embodiment of FIG. 5, the outer diameters of feed wheel 40 and agitator 42 overlap by a distance D.

Figure 2:
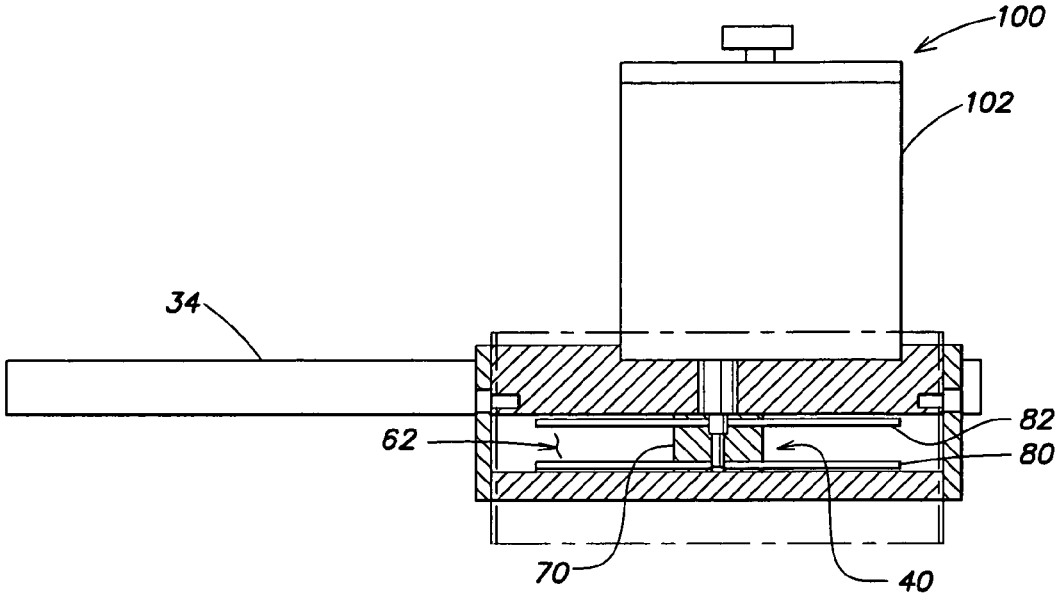
FIG. 2 is a cross-sectional top view of the powder feed system shown in FIGS. 1A and 1B.
Figure 3:
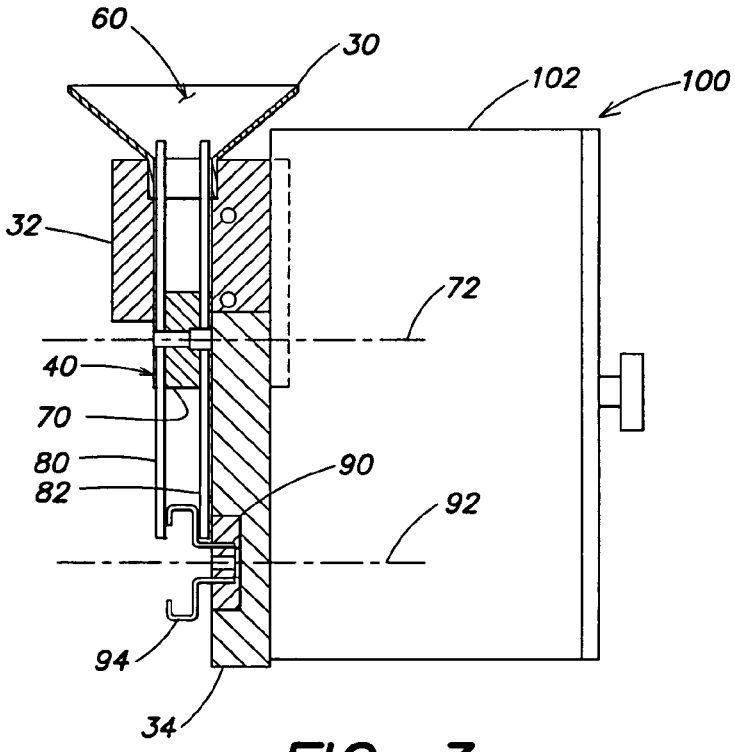
FIG. 3 is a cross-sectional side elevation view of the powder feed system of FIGS. 1A and 1B.

As shown in FIGS. 1-3, agitator 42 is positioned below and to the right of feed wheel axis 72, in the case of counterclockwise rotation of these elements. Feed wheel 40 pushes powder along the sloping surface of insert 52 toward agitator 42, which in turn pushes the powder into powder outlet 64. In this embodiment, powder outlet 64 is a space, at the bottom of feed chamber 62, between inserts 50 and 52.

As shown in FIG. 5, a drive module 100 can include an enclosure 102 mounted to the back side of flange plate 34. Enclosure 102 can enclose a feed wheel motor 110 and an agitator motor 112. Feed wheel motor 110 is coupled to feed wheel 40 and produces rotation of feed wheel 40 about feed wheel axis 72. Agitator motor 112 is coupled to agitator 42 and produces rotation of agitator 42 about agitator axis 92.

In one embodiment, each of the motors 110 and 112 is a brushless DC gear motor. Other types of motors, such as AC motors, can be utilized within the scope of the invention. Furthermore, feed wheel motor 110 and agitator motor 112 can be replaced with a single motor and a gear assembly to drive feed wheel 40 and agitator 42 at the required rotational speeds. The gear assembly establishes a desired ratio of the feed wheel rotational speed to the agitator rotational speed. In general, any suitable drive mechanism can be utilized to drive feed wheel 40 and agitator 42 at the required rotational speeds.

The rotational speed of feed wheel 40 and the rotational speed of agitator 40 are selected to optimize powder feed performance for a given powder or a given range of powder characteristics. The rotational speeds of the feed wheel and the agitator and the ratio of rotational speeds can be based on the flow characteristics of the powder being processed. In some embodiments, the rotational speed of feed wheel 40 is in a range of 0.1 to 2 rpm and the rotational speed of agitator 42 is in a range of 30 to 40 rpm. However, the rotational speeds are not limited to these ranges and can be varied depending on the flow characteristics of the powder.

In some embodiments, the dosing wheel 12 rotates intermittently in 90° increments (for a dosing wheel having four dose holes spaced apart by 90°), with each 90° rotation being considered a fill cycle. The dosing wheel stops with dosing hole 20 positioned under powder outlet 64. In other embodiments, the dosing wheel 12 can rotate continuously relative to powder outlet 64. In each case, the rotation speed of agitator 42 can be set such that at least one of agitator elements 94 passes over dosing hole 20 when it is positioned under powder outlet 64.

The drive module can be designed to bring the motor shafts into precise alignment with the agitator shaft and the feed wheel shaft. This allows the couplings on the motors to engage slots in the shafts, creating mechanical drive couplings. The motors are mounted in the drive module using spring-loaded hubs so that it is not necessary to align the slot in the shaft with the motor coupling. When the motors are started, the couplings engage as soon as they rotate into alignment with the slots in the respective shafts.

The size and shape of the feed chamber 62 can be configured to enhance performance of the powder feed system. In particular, the feed chamber 62 can be configured to limit dead space where powder can accumulate and become compacted, so that powder moves through the feed chamber 62 in a short time and does not remain in feed chamber 62 for extended periods. In some embodiments, the feed chamber walls are configured to match or conform to the volumes through which feed wheel 40 and agitator 42 rotate. For example, the feed chamber 62 can have an inside wall that, adjacent to feed wheel 40, is slightly larger in diameter than feed wheel 40 and, adjacent to agitator 42, is slightly larger in diameter than agitator 42 to permit rotation of these components without contacting the chamber wall. In further embodiments, the walls of feed chamber 62 can have a shape, such as a linear ramp, that does not conform to the outer diameter of feed wheel 40 or agitator 42 but which guides powder toward powder outlet 64. In some embodiments, the size and shape of feed chamber 62 is determined during the initial design of the powder feed system. In other embodiments, the size and shape of feed chamber 62 is determined by providing one or more chamber inserts, such as chamber inserts 50 and 52, to modify an existing feed chamber.

The chamber inserts 50 and 52 limit the size of the feed chamber 62, which in turn limits the amount of powder in the chamber at any given time, so that a controlled bed height over the power outlet 64 is maintained. This improves the powder filling consistency. Chamber insert 50 establishes the right side boundary of feed chamber 62 on the upstroke of feed wheel 40, and chamber insert 52 establishes the left side boundary of feed chamber 62 on the downstroke of feed wheel 40, as shown in FIG. 1.

The rotation of the feed wheel 40 moves powder toward an upstroke surface of upstroke chamber insert 50. The upper section of insert 50 is concave in shape with a relatively steep rise and can have a radius of curvature that is slightly larger than the radius of the feed wheel 40. This shape reduces dead space in the feed chamber 62 and allows powder that did not transfer to agitator 42 to recirculate. The lower portion of insert 50 is vertical or nearly vertical with a gradual inward curvature toward powder outlet 64 near the bottom. This shape insures that powder is directed down toward powder outlet 64. The bottom of insert 50 can have a radius of curvature that is slightly larger than the radius of agitator 42. While the lower section of insert 50 should be vertical or nearly vertical, the upper section can be modified to accommodate different feed wheel designs, but insert 50 should be generally vertical in overall shape and should limit dead space. The underside of insert 50 can be shaped to accommodate a scraper to prevent escape of powder from the feed chamber.

Downstroke chamber insert 52 also limits dead space in the feed chamber 62. The rotation of feed wheel 40 moves powder away from insert 52 and into the agitator 42 In the embodiment of FIGS. 1A-5, chamber insert 52 has a downwardly sloping downstroke surface that defines a linear ramp. The chamber insert 52 has a relatively steep angle that permits the feed wheel 40 to clear insert 52 and provides a straight path for powder to be fed down into agitator 42, which captures and pushes the powder over the powder outlet 64. The angle of insert 52 can be varied to accommodate different feed wheel designs and powders with different physical characteristics.

In other embodiments, the housing that defines feed chamber 62 is designed to provide a feed chamber shape as described above, without the use of separate inserts. As noted, the feed chamber can be sized and shaped to thereby limit dead space where powder can accumulate and become compacted. The thickness of the feed chamber 62 can be selected to accommodate the axial dimensions of feed wheel 40 and agitator 42, while avoiding dead space in the feed chamber.

Figure 7:
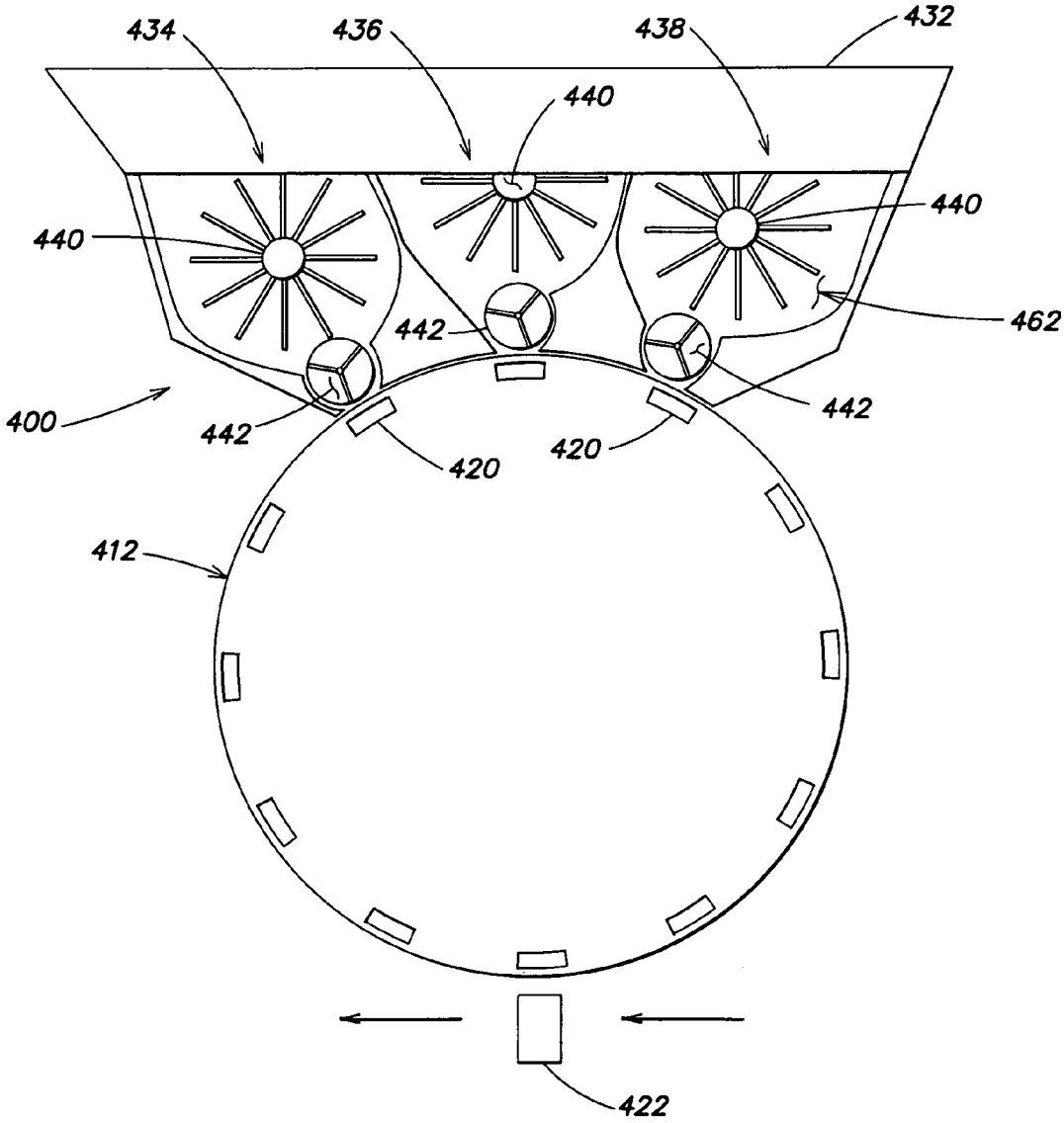
FIG. 7 is a schematic cross-sectional view of a powder feed system in accordance with a third embodiment of the invention.

In some embodiments, two or more sets of feed wheels 40 and agitators 42 are provided for increased powder feeding capacity. Each set including a feed wheel and an agitator forms a powder feed section of the powder feed system. The two or more sets of feed wheels and agitators can be mounted in one or more larger chambers or can be mounted in subchambers of the feed chamber. In some embodiments, the thickness of feed chamber 62 can be increased and subchambers can be defined by dividing walls spaced along the axis of rotation of the feed wheel. In further embodiments, two or more sets of feed wheels and agitators can be spaced circumferentially around the dosing wheel, as shown in FIG. 7 and described below. One or more drive mechanisms can be used to drive the two or more sets of feed wheels and agitations.

In operation, powder is loaded into the hopper 30 until the powder reaches the tips of the feed wheel pins 74. The motors 110 and 112 are energized and the agitator rotates at a speed that allows filling of the powder outlet 64 by an agitator element 94 passing over the outlet at least once on each fill cycle and in the same direction as the surface of the dosing wheel 12. The feed wheel 40 rotates in the same direction and at a slower speed to prevent compacting of the powder but keeping the agitator 42 supplied with powder. The feed wheel pins extend into the tip radius of the agitator pins to insure sufficient transfer of powder and at the same time moving excess powder over the agitator and maintaining a consistent pressure on the outlet area to maintain accurate dosing. By minimizing compression of the powder, it will deaggregate more reproducibly, for example in an inhaler, and give more consistent performance.

Figure 6:
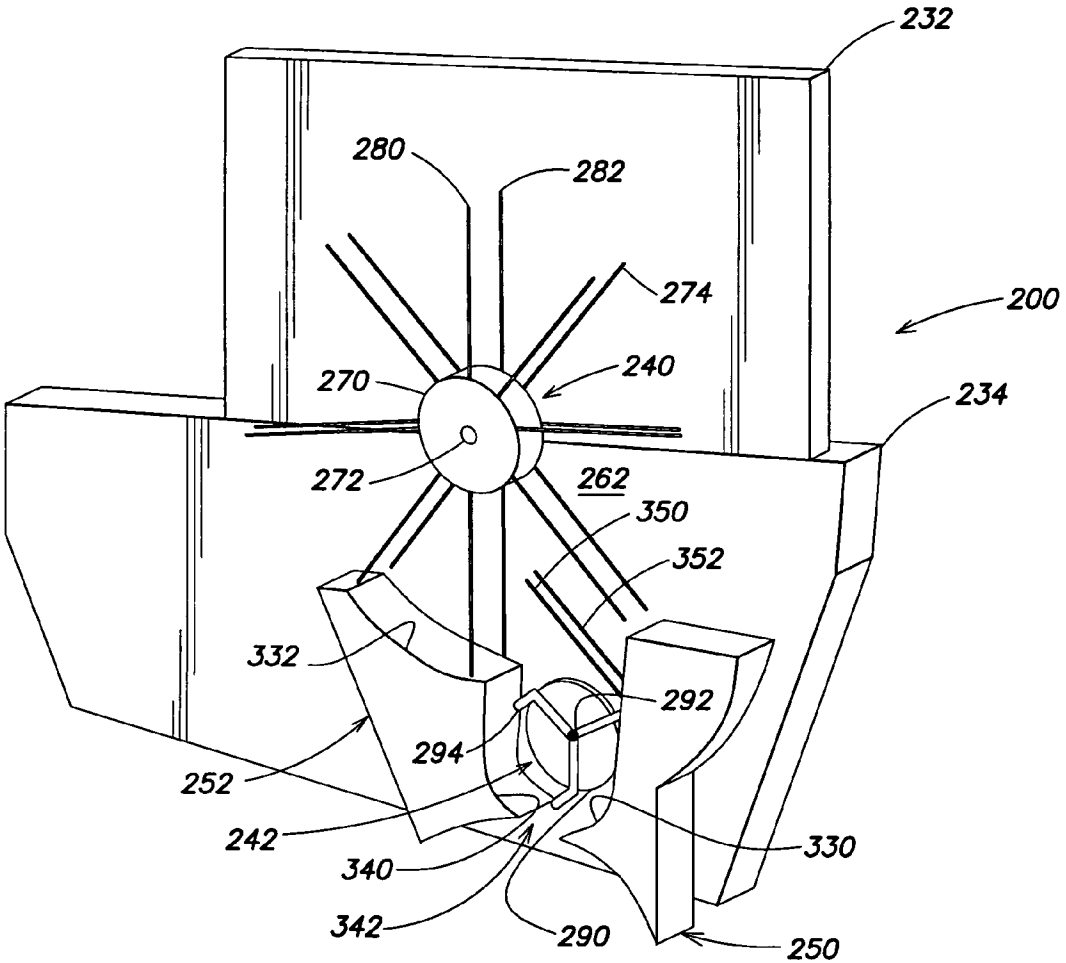
FIG. 6 is a perspective view of a powder feed system in accordance with a second embodiment of the invention.

A second embodiment of a powder feed system is shown in FIG. 6. A powder feed system 200 includes a feed frame 232, a flange plate 234, a feed wheel 240, an agitator 242, an upstroke chamber insert 250 and a downstroke chamber insert 252. Feed frame 232 is part of a housing which defines a feed chamber 262. Powder feed system 200 can include a hopper (not shown in FIG. 6) as described above.

Feed wheel 240 includes a feed wheel hub 270 that rotates about a feed wheel axis 272 and feed wheel pins 274 extend radially from feed wheel hub 270. In the embodiment of FIG. 6, feed wheel 240 includes 16 pins 274, including a first pin set 280 of 8 pins and a second pin set 282 of 8 pins. The pin sets 280 and 282 are axially spaced apart along feed wheel axis 272. The pins of each pin set can be spaced apart at 45° intervals. In the embodiment of FIG. 6, the pins of pin sets 280 and 282 are circumferentially aligned.

Agitator 242 can include an agitator hub 290 that rotates about an agitator axis 292, and agitator elements 294 affixed to agitator hub 290. The agitator 242 can be configured as described above in connection with agitator 42.

Upstroke chamber insert 250 can include a curved edge 330 having a curvature that is based on the diameter of agitator 242. Downstroke chamber insert 252 can include a curved edge 332 that is based on the diameter of feed wheel 240 and a curved edge 340 having a curvature that is based on the diameter of agitator 242. Together, curved edge 330 of chamber insert 250 and curved edge 340 of chamber insert 252 define a U-shaped volume of feed chamber 262 that contains agitator 242. A gap between chamber inserts 250 and 252 defines an outlet 342 of feed chamber 262. As in the first embodiment, the feed wheel 240 provides a continuous supply of powder to agitator 242, so that the agitator is not deprived of powder.

Powder feed system 200 can further include auxiliary pins 350 and 352 which are affixed to upstroke chamber insert 250 and which extend upwardly at an angle above agitator 242 and between pin sets 280 and 282 of feed wheel 240. Auxiliary pins 350 and 352 direct powder being moved by a feed wheel 240 downwardly toward agitator 242 and thereby enhance performance of the powder feed system.

A schematic diagram of a powder fill system in accordance with a third embodiment of the invention is shown in FIG. 7. The powder fill system includes a powder feed system 400 which supplies powder to a dosing wheel 412. Dosing wheel 412, in turn, dispenses controlled quantities of powder to containers 422. The dosing wheel 412 includes a series of dosing holes 420 around its periphery. The dosing holes 420 retain powder by suction.

Powder feed system 400 includes a feed frame 432 for receiving a powder, and powder feed sections 434, 436 and 438. Each of powder feed sections 434, 436 and 438 includes a feed wheel 440 and an agitator 442 positioned in a feed chamber 462, and a drive mechanism (not shown) for rotating feed wheel 440 and agitator 442. Each of the powder feed sections 434, 436 and 438 may be configured as described above. Feed sections 434, 436 and 438 include powder outlets for delivering powder to respective holes 420 on dosing wheel 412. The powder feed system 400 of FIG. 7 can provide increased throughput in comparison with powder feed systems having a single powder feed section.

Having thus described several aspects of several embodiments of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A powder fill system comprising:

a housing defining a feed chamber to hold powder, the feed chamber having a powder inlet and a powder outlet;

at least one feed wheel in the feed chamber, the feed wheel rotating about a horizontal feed wheel axis, wherein the feed wheel comprises a feed wheel hub and pins that extend radially from the feed wheel hub, wherein the pins include a first pin set and a second pin set, and wherein the first and second pin sets are axially spaced apart along the feed wheel axis;

at least one agitator positioned in the feed chamber to move the powder from the feed wheel to the powder outlet of the feed chamber, the agitator rotating about a horizontal agitator axis, the powder outlet being located at the bottom of the feed chamber under the agitator, so that the agitator pushes powder over the powder outlet, wherein the agitator comprises an agitator hub mounted for rotation about the agitator axis and agitator elements that extend from the agitator hub, wherein the agitator elements comprise J-shaped pins affixed to the agitator hub, each of the J-shaped pins including a straight base section that pushes powder toward the powder outlet, wherein the J-shaped pins of the agitator rotate between the pins of the first and second pin sets of the feed wheel and wherein the outer diameters of the feed wheel and the agitator overlap;

a drive mechanism to rotate the feed wheel about the feed wheel axis and to rotate the agitator about the agitator axis; and a powder dispensing device positioned below the powder outlet to receive powder through the powder outlet and to dispense a controlled quantity of powder to a powder container.

2. A powder fill system as defined in claim 1, wherein pins of the first pin set are circumferentially offset with respect to pins of the second pin set.

3. A powder fill system as defined in claim 1, wherein pins of the first pin set are circumferentially aligned with pins of the second pin set.

4. A powder fill system as defined in claim 1, wherein the feed chamber includes a downstroke surface on a downstroke side of the feed wheel, the downstroke surface having a sloped configuration to guide powder toward the powder outlet.

5. A powder fill system as defined in claim 4, wherein the downstroke surface is defined by a downstroke chamber insert mounted in the feed chamber.

6. A powder fill system as defined in claim 1, wherein the feed chamber includes an upstroke surface on an upstroke side of the feed wheel, the upstroke surface having first and second curvatures based on diameters of the feed wheel and the agitator, respectively.

7. A powder fill system as defined in claim 6, wherein the upstroke surface is defined by an upstroke chamber insert mounted in the feed chamber.

8. A powder fill system as defined in claim 7, further comprising one or more auxiliary pins extending upwardly at an angle from the upstroke chamber insert above the agitator.

9. A powder fill system as defined in claim 1, wherein the housing includes a hopper to facilitate loading of powder into the feed chamber.

10. A powder fill system as defined in claim 1, wherein the agitator is positioned above the outlet of the feed chamber.

11. A powder fill system as defined in claim 1, wherein the feed wheel and the agitator rotate in the same direction.

12. A powder fill system as defined in claim 1, wherein the agitator has a smaller diameter than the feed wheel.

13. A powder fill system as defined in claim 1, wherein the feed chamber is configured to limit dead space where powder can accumulate and become compacted.

14. A powder fill system as defined in claim 1, wherein the drive mechanism comprises a feed wheel motor to rotate the feed wheel about the feed wheel axis and an agitator motor to rotate the agitator about the agitator axis.

15. A powder fill system as defined in claim 1, wherein the drive mechanism rotates the feed wheel at a speed of 0.1 to 2 rpm and rotates the agitator at a speed of 30 to 40 rpm.

16. A powder fill system as defined in claim 1, comprising two or more powder feed sections, each including a housing defining a feed chamber, a feed wheel and an agitator in the feed chamber and a drive mechanism to rotate the feed wheel and the agitator.

17. A powder fill system as defined in claim 1, wherein the powder dispensing device comprises a dosing wheel and a drive mechanism to rotate the dosing wheel with respect to the powder outlet and the powder container.

18. A powder fill system as defined in claim 17, wherein the dosing wheel includes a plurality of dosing holes, wherein the agitator includes agitator elements and wherein the agitator is rotated at a speed such that at least one of the agitator elements passes over one of the dosing holes when the dosing hole is positioned under the powder outlet.

* * * * *